US009625859B2

(12) United States Patent
Yoshida et al.

(10) Patent No.: US 9,625,859 B2
(45) Date of Patent: Apr. 18, 2017

(54) INTERMEDIATE TRANSFERRING BELT AND IMAGE-FORMING APPARATUS

(71) Applicant: Konica Minolta, Inc., Tokyo (JP)

(72) Inventors: Eiichi Yoshida, Hino (JP); Sadaaki Sakamoto, Hino (JP); Takayuki Suzuki, Niiza (JP); Ito Koga, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/133,664

(22) Filed: Apr. 20, 2016

(65) Prior Publication Data

US 2016/0320725 A1 Nov. 3, 2016

(30) Foreign Application Priority Data

Apr. 30, 2015 (JP) ..... 2015-092579

(51) Int. Cl.
*G03G 15/01* (2006.01)
*G03G 15/16* (2006.01)

(52) U.S. Cl.
CPC ..... *G03G 15/162* (2013.01)

(58) Field of Classification Search
CPC ..... G03G 15/162
USPC ..... 399/302, 308
See application file for complete search history.

(56) References Cited

U.S. PATENT DOCUMENTS

2013/0149541 A1* 6/2013 Sakamoto ..... G03G 15/162 428/411.1

FOREIGN PATENT DOCUMENTS

JP 2009062499 A 3/2009

* cited by examiner

*Primary Examiner* — Hoang Ngo
(74) *Attorney, Agent, or Firm* — Lucas & Mercanti, LLP

(57) ABSTRACT

An intermediate transferring belt and an image-forming apparatus are shown. The intermediate transferring belt is to be mounted in an electrophotographic image-forming apparatus. The intermediate transferring belt includes the following, in sequence, a substrate; an elastic layer; and a surface layer. The surface layer includes an acrylic resin including a copolymer of a urethane acrylate and one or more acrylates selected from the group consisting of a monofunctional acrylate having an alicyclic structure and a monofunctional acrylate having a heterocyclic structure.

5 Claims, 2 Drawing Sheets

INTERMEDIATE TRANSFERRING BELT AND IMAGE-FORMING APPARATUS

BACKGROUND OF THE INVENTION

Field of the Invention

The present invention relates to an intermediate transferring belt and an image-forming apparatus including the intermediate transferring belt.

Description of Related Art

In an electrophotographic image-forming apparatus, a latent image formed on an image retainer (photoreceptor) is developed with a toner, the resultant toner image is temporarily retained on an endless intermediate transferring belt, and then the toner image on the intermediate transferring belt is transferred onto an image support, such as a sheet of paper.

An image-forming apparatus proposed for further improvement of image quality includes an intermediate transferring belt including a substrate and an elastic layer disposed on the substrate and composed of an elastic material, such as rubber. The intermediate transferring belt comes into close contact with a sheet of coarse paper and exhibits improved image transferability.

Unfortunately, the intermediate transferring belt has poor wear resistance because the exposed elastic layer is composed of rubber or a soft material, and the surface of the transferring belt may be scraped during the use thereof.

A technique for solving such a problem involves coating of the elastic layer with a surface layer composed of a cross-linked resin prepared through the polymerization of a cross-linkable monomer. Japanese Patent Application Laid-Open Publication No. 2009-62499 proposes a combination of monomers, for example, a polyfunctional acrylate and a urethane acrylate, for preparing such a cross-linked resin.

Unfortunately, the surface layer composed of a cross-linked resin prepared from a copolymer of a polyfunctional acrylate and a urethane acrylate is less likely to conform to the elastic layer, resulting in damages (e.g. cracking) to a bent portion of the surface layer during the circulation of the intermediate transferring belt.

BRIEF SUMMARY OF THE INVENTION

The present invention has been attained in consideration of the circumstances described above. An object of the present invention is to provide an intermediate transferring belt exhibiting excellent image transferability to a sheet of coarse paper, high wear resistance, and sufficient cracking resistance. Another object of the present invention is to provide an image-forming apparatus including the intermediate transferring belt.

According to an aspect of the present invention there is provided an intermediate transferring belt to be mounted in an electrophotographic image-forming apparatus, the intermediate transferring belt including, in sequence:

a substrate;

an elastic layer; and a surface layer, wherein, the surface layer includes an acrylic resin including a copolymer of a urethane acrylate and one or more acrylates selected from the group consisting of a monofunctional acrylate having an alicyclic structure and a monofunctional acrylate having a heterocyclic structure.

Preferably, in the intermediate transferring belt, wherein the alicyclic structure in the monofunctional acrylate having an alicyclic structure includes a cycloalkyl group.

Preferably, in the intermediate transferring belt, the heterocyclic structure in the monofunctional acrylate having the heterocyclic structure includes a saturated heterocyclic ring.

Preferably, in the intermediate transferring belt, a mass ratio of the urethane acrylate to the one or more acrylates selected from the group consisting of the monofunctional acrylate having the alicyclic structure and the monofunctional acrylate having the heterocyclic structure is within a range of 10/90 to 50/50.

BRIEF DESCRIPTION OF THE DRAWINGS

The present invention will become more fully understood from the detailed description given hereinbelow and the appended drawings, and thus are not intended to define the limits of the present invention, and wherein.

DETAILED DESCRIPTION OF PREFERRED EMBODIMENTS

The intermediate transferring belt of the present invention includes a surface layer composed of an acrylic resin containing a copolymer of a urethane acrylate and one or more acrylates selected from the group consisting of monofunctional acrylates having an alicyclic structure and monofunctional acrylates having a heterocyclic structure. The intermediate transferring belt exhibits excellent image transferability to a sheet of coarse paper, high wear resistance, and sufficient cracking resistance.

The present invention will now be described in detail.

[Intermediate Transferring Belt]

Figure 1:
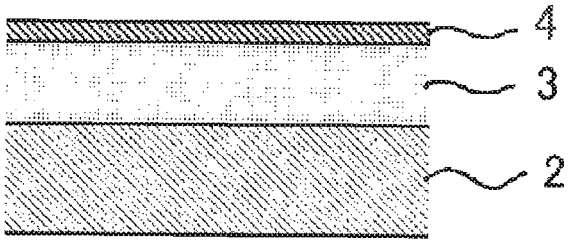
FIG. 1 is a cross-sectional view illustrating an exemplary configuration of an intermediate transferring belt according to the present invention.

The intermediate transferring belt of the present invention is in the form of, for example, an endless belt used in an electrophotographic image-forming apparatus. As illustrated in FIG. 1, the intermediate transferring belt includes a substrate 2, an elastic layer 3 disposed on the substrate 2, and a surface layer 4 disposed on the elastic layer 3.

[Substrate 2]

The substrate 2 of the intermediate transferring belt of the present invention, which is in the form of an endless belt, for example, may have a monolayer or multilayer structure.

The substrate 2 may be composed of any material, and is preferably composed of a material having high strength and high durability, such as a polyimide (PI) resin, poly(amide-imide) (PAI) resin, poly(phenylene sulfide) (PPS) resin, or poly(ether-ether-ketone) (PEEK) resin.

The substrate 2 preferably has conductivity and is prepared by dispersion of a conductive filler in any one of the aforementioned resins.

The conductive filler may be, for example, carbon black or carbon nanotube.

The substrate 2 preferably has a thickness of 50 to 250 μm in view of mechanical strength and image quality.

[Elastic Layer 3]

The elastic layer 3 of the intermediate transferring belt of the present invention is composed of an elastic material. Examples of the elastic material include rubbers, elastomers, and resins. Particularly preferred are, for example, chloroprene rubber, nitrile-butadiene rubber, and hydrogenated nitrile-butadiene rubber in view of hardness and durability.

These elastic materials may be used alone or in combination.

The elastic layer 3 preferably has a thickness of 200 to 500 μm in view of mechanical strength and image quality.

[Surface Layer 4]

The surface layer 4 of the intermediate transferring belt of the present invention is composed of an acrylic resin containing a copolymer of (A) at least one acrylate selected from the group consisting of monofunctional acrylates having an alicyclic structure and monofunctional acrylates having a heterocyclic structure (hereinafter the selected acrylate may be referred to as "specific monofunctional acrylate") and (B) a urethane acrylate (hereinafter the acrylic resin may be referred to as "specific acrylic resin").

[Specific Monofunctional Acrylate (A)]

The specific monofunctional acrylate contained in the specific acrylic resin has one acryloyl group and an alicyclic structure and/or a heterocyclic structure per molecule.

The monofunctional acrylate having an alicyclic structure is preferably a compound having a cycloalkyl or dicycloalkyl group, particularly preferably a compound having a cycloalkyl group.

Specific examples of the monofunctional acrylate having an alicyclic structure include cyclohexyl acrylate, 1,4-cyclohexanedimethanol monoacrylate, dicyclopentenyl acrylate, dicyclopentenyloxyethyl acrylate, and dicyclopentanyl acrylate.

The monofunctional acrylate having a heterocyclic structure is preferably a compound having a saturated heterocyclic ring. The monofunctional acrylate having a heterocyclic structure is preferably a compound having a five-, six-, or seven-membered heterocyclic ring.

Specific examples of the monofunctional acrylate having a heterocyclic structure include tetrahydrofurfuryl acrylate, piperidyl acrylate, pentamethylpiperidyl acrylate, and 4-acryloylmorpholine.

These specific monofunctional acrylates may be used alone or in combination.

[Urethane Acrylate (B)]

Urethane acrylate (B) may be any compound having a urethane bond and one or more acryloyloxy groups per molecule.

Urethane acrylate (B) may be, for example, an oligomer or polymer having a urethane bond in the main chain and at least one acryloyloxy group bonded to an end of the main chain or to a side chain.

Urethane acrylate (B) has a number average molecular weight of preferably 3,000 to 30,000 (inclusive), particularly preferably 10,000 to 20,000 (inclusive).

The use of urethane acrylate (B) having a number average molecular weight falling within the above range ensures the specific acrylic resin to have flexibility and extensibility and prevents a reduction in strength.

The number average molecular weight of urethane acrylate (B) is determined by gel permeation chromatography.

The aforementioned urethane acrylates may be used alone or in combination.

The copolymerization ratio or mass ratio of urethane acrylate (B) to specific monofunctional acrylate (A) is preferably 10/90 to 50/50 in the copolymer contained in the specific acrylic resin.

If the copolymerization ratio of urethane acrylate (B) to specific monofunctional acrylate (A) falls within the above range in the copolymer contained in the specific acrylic resin, the intermediate transferring belt reliably exhibits excellent image transferability to a sheet of coarse paper, high wear resistance, and high cracking resistance. A copolymerization ratio of urethane acrylate (B) of less than 50 mass % may lead to insufficient toughness of the surface layer, resulting in unsatisfactory wear resistance. A copolymerization ratio of urethane acrylate (B) exceeding 90 mass % may lead to insufficient hardness and poor wear resistance of the surface layer, resulting in scraping of the surface layer by an image support (e.g., paper) or a sliding member (e.g., photoreceptor).

The specific acrylic resin may contain a copolymer of specific monofunctional acrylate (A), urethane acrylate (B), and an additional polymerizable component. The additional polymerizable component may be incorporated in a small amount such that the component does not adversely affect cracking resistance and wear resistance. The additional polymerizable component is, for example, an acrylate having three or more functional groups.

The surface layer 4 may optionally contain an additive, such as an organic solvent, a photostabilizer, a UV absorbent, a catalyst, a colorant, an antistatic agent, a lubricant, a leveling, an antifoaming agent, a polymerization promoter, an antioxidant, a flame retardant, an IR absorbent, a surfactant, or a surface modifier.

The surface layer 4 preferably has a coefficient of friction of 0.5 or less.

The surface layer 4 having a coefficient of friction of 0.5 or less ensures a tack-free surface.

The coefficient of friction of the surface layer 4 is determined with a portable tribometer "TYPE 94i-II" (manufactured by Shinto Scientific Co., Ltd.) having a contact covered with cotton flannel.

The surface layer 4 preferably has an elongation at break of 15 to 200%.

The surface layer 4 having an elongation at break of 15% or more leads to high cracking resistance.

The surface layer 4 having an elongation at break of 200% or less leads to high wear resistance.

The elongation at break of the surface layer 4 (in a single-layer form) is determined in accordance with JIS K7161.

The surface layer 4 has a thickness of preferably 0.5 to 10 μm, more preferably 0.5 to 5 μm, in view of mechanical strength and image quality.

The intermediate transferring belt exhibits excellent image transferability to a sheet of coarse paper, high wear resistance, and sufficient cracking resistance because the surface layer 4 is composed of the specific acrylic resin containing a copolymer of specific monofunctional acrylate (A) and urethane acrylate (B).

Since specific monofunctional acrylate (A) has an alicyclic structure and/or a heterocyclic structure, molecular motion is restricted in the resin contained in the surface layer 4 as compared with the case of the use of a chain-form monofunctional acrylate, and the surface layer 4 has adequate hardness and intended wear resistance. Unlike the case of the use of a polyfunctional acrylate, no cross-linked structure is formed in the resin contained in the surface layer 4, and the surface layer 4 does not have excessively high hardness. Thus, the surface layer 4 conforms to the elastic layer 3 even at a bent portion, and exhibits intended cracking resistance.

Since specific monofunctional acrylate (A) is highly randomly copolymerized as compared with a monofunctional acrylate having an aromatic ring or a straight-chain structure, the resultant copolymer does not have a very hard or soft portion, resulting in excellent wear resistance and cracking resistance.

The copolymer of specific monofunctional acrylate (A) and urethane acrylate (B) has an adequately high glass transition point, and thus achieves a tack-free surface.

[Production of Intermediate Transferring Belt]

The intermediate transferring belt of the present invention is produced through, for example, the following procedure: A coating solution for formation of an elastic layer is applied to the substrate 2, and the resultant coating film is dried, to form the elastic layer 3. A coating solution containing a polymerization initiator and a polymerizable component containing specific monofunctional acrylate (A) and urethane acrylate (B) (hereinafter the coating solution may be referred to as "coating solution for formation of a surface layer") is applied to the elastic layer 3, and the resultant coating film is irradiated with active energy rays for polymerization of the polymerizable component, to form the surface layer 4.

The preparation of the substrate 2 from a polyimide resin may involve any appropriate conventional process. For example, a polyamic acid solution is formed into a ring-shaped layer through a process involving application of the solution to the outer surface of a cylindrical mold, a process involving application of the solution to the inner surface of the mold, a process further centrifuging the above, or a process involving filling of a casting mold with the solution. The resultant layer is dried and shaped into a belt-like product, and the product is heated to convert the polyamic acid into an imide, followed by recovery of the resultant product from the mold (see, for example, Japanese Patent Application Laid-Open Publication Nos. S61-95361, S64-22514, and H03-180309). The preparation of an endless-belt substrate may involve any appropriate process, such as a mold releasing process or a defoaming process.

The coating solution for formation of an elastic layer is prepared by addition of a material for the elastic layer to a solvent in an amount of 20 to 30 mass % (in terms of solid content).

The coating solution is applied to the substrate through dipping, for example.

The coating solution for formation of a surface layer may contain any polymerization initiator that can initiate polymerization of the polymerizable component with active energy rays, such as light.

The polymerization initiator may be a photopolymerization initiator. Examples of such a photopolymerization initiator include acetophenone compounds, benzoin ether compounds, benzophenone compounds, sulfur compounds, azo compounds, peroxide compounds, and phosphine oxide compounds.

Specific examples of the polymerization initiator include carbonyl compounds, such as benzoin, benzoin methyl ether, benzoin ethyl ether, benzoin isopropyl ether, acetoin, butyroin, toluoin, benzil, benzophenone, p-methoxybenzophenone, diethoxyacetophenone, α,α-dimethoxy-α-phenylacetophenone, methyl phenylglyoxylate, ethyl phenylglyoxylate, 4,4'-bis(dimethylaminobenzophenone), 2-hydroxy-2-methyl-1-phenylpropane-1-one, 2,2-dimethoxy-1,2-diphenylethan-1-one, and 1-hydroxycyclohexyl phenyl ketone; sulfur compounds, such as tetramethylthiuram monosulfide and tetramethylthiuram disulfide; azo compounds, such as azobisisobutyronitrile and azobis-2,4-dimethylvaleronitrile; and peroxide compounds, such as benzoyl peroxide and di-t-butyl peroxide. These polymerization initiators may be used alone or in combination.

Preferred are 1-hydroxycyclohexyl phenyl ketone, 2-hydroxy-2-methyl-1-phenylpropane-1-one, and 1-[4-(2-hydroxyethoxy)-phenyl]-2-hydroxy-2-methyl-1-propane-1-one in view of photostability, highly efficient photocleavage, surface curability, compatibility with a specific acrylic resin, low volatility, and low odor.

The coating solution for formation of a surface layer preferably contains a polymerization initiator in an amount of 1 to 10 mass %. The amount of the polymerization initiator is more preferably 2 to 8 mass %, still more preferably 3 to 6 mass %, in view of high curability, sufficient hardness of the resultant surface layer, and high adhesion of the surface layer to the elastic layer.

The coating solution for formation of a surface layer preferably contains a solvent in view of an improvement in applicability (workability).

Specific examples of the solvent include ethanol, isopropanol, butanol, toluene, xylene, acetone, methyl ethyl ketone, ethyl acetate, butyl acetate, ethylene glycol diethyl ether, and propylene glycol monomethyl ether acetate.

The coating solution for formation of a surface layer may be prepared by dissolution or dispersion, in a solvent, of a polymerizable component containing specific monofunctional acrylate (A) and urethane acrylate (B), a polymerization initiator, and an optional additive.

The coating solution for formation of a surface layer preferably has a viscosity of 10 to 100 cP.

The coating solution for formation of a surface layer preferably has a solid content of 5 to 40 mass %. In the coating solution, the solid content corresponds to the total amount of specific monofunctional acrylate (A) and urethane acrylate (B).

The coating solution for formation of a surface layer is applied to the elastic layer through, for example, dip coating or spray coating.

The polymerizable component is cured through irradiation with active energy rays.

The active energy rays may be, for example, UV rays, electron beams, or γ-rays. Preferred are UV rays in view of easy handling and availability of high energy. Any UV source may be used. Examples of the UV source include low-pressure mercury lamps, middle-pressure mercury lamps, high-pressure mercury lamps, ultrahigh-pressure mercury lamps, carbon-arc lamps, metal halide lamps, and xenon lamps. The source of active energy rays may be, for example, an ArF excimer laser, a KrF excimer laser, an excimer lamp, or a synchrotron radiation source. A UV laser is preferably used for application of active energy rays in a spotted pattern.

The conditions of irradiation with active energy rays may vary depending on the type of the active energy ray source. The dose of active energy rays is preferably 500 $mJ/cm^2$ or more, more preferably 0.5 to 5 $J/cm^2$, particularly preferably 1 to 3 $J/cm^2$, in view of even curing, hardness, curing time, and curing speed.

The dose of active energy rays is determined with an accumulated UV meter UIT-250 (manufactured by USHIO INC.)

The time of irradiation with active energy rays is preferably 10 seconds to 8 minutes, more preferably 30 seconds to 5 minutes, in view of curing or operational efficiency.

The polymerizable component may be cured in an air atmosphere through irradiation with active energy rays. The oxygen concentration of the atmosphere is preferably 1% or less, particularly preferably 500 ppm or less, in view of even curing and curing time. Such an oxygen concentration is effectively achieved by introduction of nitrogen gas into the atmosphere during irradiation with active energy rays.

The oxygen concentration is determined with an oxygen analyzer for monitoring ambient gas "OX100" (manufactured by Yokogawa Electric Corporation).

Preferably, the coating solution for formation of a surface layer is applied to the elastic layer and then the coating film is dried to remove the solvent.

The coating film may be dried before, during, or after the polymerization of the polymerizable component. The process can be suitably selected and combined. Preferably, a first drying process is performed until the coating film loses its fluidity, the polymerizable component is then polymerized, and a second drying process is then performed for adjusting the amount of the volatile material contained in the surface layer to a specific level.

The coating film may be dried by a process that is appropriately selected depending on the type of the solvent and the thickness of the surface layer to be formed. The drying temperature is preferably, for example, 60 to 120° C., more preferably 60 to 100° C. The drying time is preferably, for example, 1 to 10 minutes, more preferably about five minutes.

[Image-Forming Apparatus]

The image-forming apparatus of the present invention includes the intermediate transferring belt. The image-forming apparatus of the present invention may be of any known electrophotographic type, such as a monochromatic or full-color image-forming apparatus.

Figure 2:
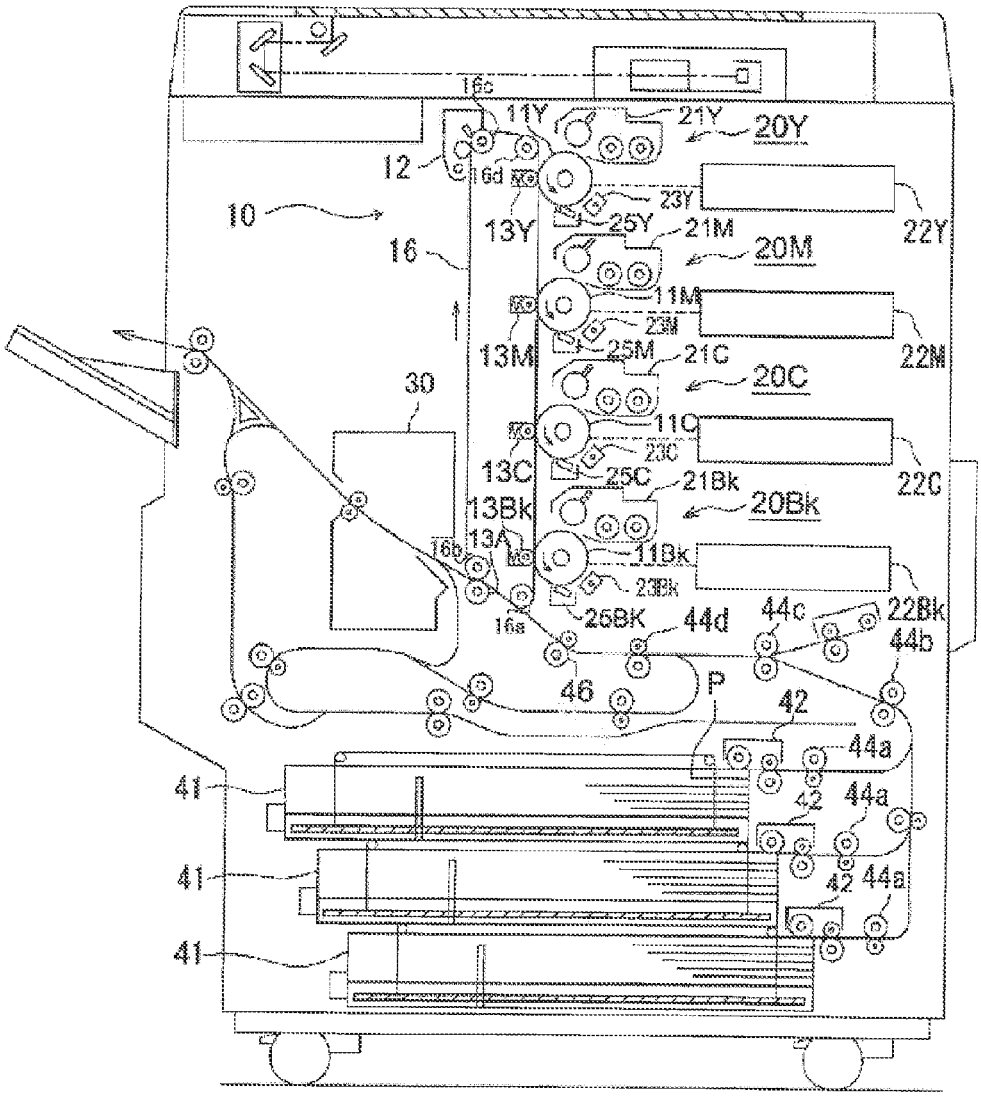
FIG. 2 is a cross-sectional view illustrating an exemplary configuration of an image-forming apparatus according to the present invention.

FIG. 2 is a cross-sectional view illustrating an exemplary configuration of the image-forming apparatus of the present invention.

The image-forming apparatus includes image-forming units 20Y, 20M, 20C, and 20Bk; an intermediate transferring unit 10 for transferring toner images formed by the image-forming units 20Y, 20M, 20C, and 20Bk onto an image support P; and a fixing unit 30 for fixing the toner images onto the image support P through heating and application of pressure.

The image-forming unit 20Y forms a yellow toner image, the image-forming unit 20M forms a magenta toner image, the image-forming unit 20C forms a cyan toner image, and the image-forming unit 20Bk forms a black toner image.

The image-forming units 20Y, 20M, 20C, and 20Bk respectively include photoreceptors (i.e. image retainers) 11Y, 11M, 11C, and 11Bk; charging units 23Y, 23M, 23C, and 23Bk for proving the surfaces of the photoreceptors 11Y, 11M, 11C, and 11Bk with a uniform potential; exposing units 22Y, 22M, 22C, and 22Bk for forming electrostatic latent images of desired patterns on the uniformly charged photoreceptors 11Y, 11M, 11C, and 11Bk; developing units 21Y, 21M, 21C, and 21Bk for transferring color toners onto the photoreceptors 11Y, 11M, 11C, and 11Bk to develop the electrostatic latent images into toner images; and cleaning units 25Y, 25M, 25C, and 25Bk for recovering toners remaining on the photoreceptors 11Y, 11M, 11C, and 11Bk after the first transferring process.

The intermediate transferring unit 10 includes a circulating intermediate transferring belt 16; first transferring rollers (first transferring units) 13Y, 13M, 13C, and 13Bk for transferring toner images formed by the image-forming units 20Y, 20M, 20C, and 20Bk onto the intermediate transferring belt 16; a second transferring roller (second transferring unit) 13A for transferring the color toner images on the intermediate transferring belt 16 transferred from the first transferring rollers 13Y, 13M, 13C, and 13Bk onto the image support P; and a cleaning unit 12 for recovering the toner remaining on the intermediate transferring belt 16.

The intermediate transferring belt 16 is the intermediate transferring belt of the present invention.

The intermediate transferring belt 16, which is in the form of an endless belt, is strained and rotatably supported by multiple supporting rollers 16*a* to 16*d*.

The intermediate transferring belt 16 includes a substrate 2, an elastic layer 3 disposed on the outer surface of the substrate 2, and a surface layer 4 disposed on the elastic layer 3 and composed of a specific acrylic resin.

The color toner images formed by the image-forming units 20Y, 20M, 20C, and 20Bk are sequentially transferred onto the circulating endless intermediate transferring belt 16 with the first transferring rollers 13Y, 13M, 13C, and 13Bk, to form a superimposed color image. The image support P accommodated in a sheet feeding cassette 41 is fed by a sheet feeding unit 42, and is transported to the second transferring roller (second transferring unit) 13A via multiple intermediate rollers 44*a* to 44*d* and register rollers 46. The color image on the intermediate transferring belt 16 is transferred onto the image support P.

The color image transferred onto the image support P is fixed by the fixing unit 30 equipped with a thermal fixing roller. The image support P is then pinched between discharging rollers and is conveyed to a sheet receiving tray provided outside of the apparatus.

After the transfer of the color image onto the image support P with the second transferring roller 13A and the self-stripping of the image support P, the toner remaining on the endless intermediate transferring belt 16 is removed by the cleaning unit 12.

The image-forming apparatus, which includes the intermediate transferring belt, exhibits excellent image transferability to a sheet of coarse paper. The intermediate transferring belt has high wear resistance and sufficient cracking resistance.

[Developer]

The developer used in the image-forming apparatus of the present invention may be a one-component developer containing a magnetic or non-magnetic toner, or a two-component developer containing a toner and a carrier.

The developer may contain any known toner, and preferably contains a polymerized toner prepared through a polymerization process and having a volume median particle size of 3 to 9 μm. The use of such a polymerized toner achieves high resolution and even image density in the resultant image and prevents image fogging.

The two-component developer may contain any known carrier, and preferably contains a ferrite carrier composed of magnetic particles having a volume median particle size of 30 to 65 μm and a magnetization of 20 to 70 emu/g. The use of a carrier having a volume median particle size of less than 30 μm may lead to deposition of the carrier, resulting in an image with voids. The use of a carrier having a volume median particle size exceeding 65 μm may lead to formation of an image with uneven image density.

[Image Support]

Examples of the image support P used in the image-forming apparatus of the present invention include, but are not limited to, sheets of plain paper (including thin paper and thick paper), high-quality paper, coated printing paper (e.g., art paper and coated paper), and coarse paper (e.g., commercially available Japanese paper, postcard, and Leathac paper); plastic films for OHP; and fabrics.

The image-forming apparatus, which includes the intermediate transferring belt of the present invention, exhibits excellent image transferability to a sheet of coarse paper, such as Leathac paper used as the image support P.

The present invention should not be limited to the above-described embodiments, and may include various modifications.

EXAMPLES

The present invention will now be described in detail by way of Examples, which should not be construed as limiting the invention thereto.

Example 1

Production of Intermediate Transferring Belt 1

(1) Preparation of Substrate

The belt used in "bizhub PRESS C6000" (manufactured by KONICA MINOLTA, INC.) was provided as a substrate. The belt was an endless belt having a thickness of 60 m and composed of a polyimide resin containing a conductive material (carbon black). The belt served as endless-belt substrate [1].

(2) Formation of Elastic Layer

Carbon black was kneaded together with chloroprene rubber, and the resultant compound was dissolved or dispersed in toluene, to prepare coating solution [1] for formation of an elastic layer.

Coating solution [1] for formation of an elastic layer was applied to the outer surface of endless-belt substrate [1] by dip coating and then dried to form elastic layer [1] having a dry thickness of 200 μm.

(3) Formation of Surface Layer (3-1) Preparation of Coating Solution for Formation of a Surface Layer A monomer composition containing a specific monofunctional acrylate (cyclohexyl acrylate) (20 parts by mass) and a urethane acrylate "UV06630B" (manufactured by The Nippon Synthetic Chemical Industry Co., Ltd.) (80 parts by mass) and a polymerization initiator "IRGACURE 184" (manufactured by BASF) (4 parts by mass) were added to and dissolved in a solvent (ethyl acetate), to prepare coating solution [1] for formation of a surface layer.

(3-2) Formation of Surface Layer

Coating solution [1] for formation of a surface layer was applied to the outer surface of elastic layer [1] by dip coating with a coating device, to form a coating film having a dry thickness of 2 μm. The coating film was irradiated with UV rays under the conditions described below, to cure the film to form a surface layer. Intermediate transferring belt [1] was thereby produced.

—Irradiation with UV Rays—

Light source: high-pressure mercury lamp "H04-L41" (manufactured by EYE GRAPHICS CO., LTD.)

Distance between the irradiation port and the surface of the coating film: 100 mm Dose: 1 J/cm$^2$ Moving speed (circumferential speed) of the coating film relative to the fixed light source: 60 mm/second Irradiation time (time of rotation of the coating film): 240 seconds

Examples 2 to 4 and Comparative Examples 1 to 3

Production of Intermediate Transferring Belts 2 to 7

Intermediate transferring belts [2] to [7] were produced as in intermediate transferring belt [1], except that the monomer composition for formation of a surface layer was replaced with that shown in Table 1.

(1) Evaluation of Wear Resistance

Intermediate transferring belts [1] to [7] were each mounted in an image-forming apparatus "bizhub PRESS C6000" (manufactured by KONICA MINOLTA, INC.), and an image with a coverage rate of 10% was printed on 1,000,000 sheets. After this durability test, the surface of the intermediate transferring belt was observed with an optical microscope at a magnification of 1,000 and evaluated for wear resistance on the basis of the criteria described below. The results are shown in Table 1.

—Criteria of Evaluation—

A: No wear {no damage due to wear (e.g., scratching or scraping) was observed on the surface layer}(passed)

B: Wear {damage due to wear (e.g., scratching or scraping) was observed on the surface layer} (not passed)

(2) Evaluation of Cracking Resistance

After the aforementioned durability test, the number of cracks was counted in any 10 regions (area: 1 mm$^2$ in each unit) in each intermediate transferring belt to determine an average number of cracks per region. The intermediate transferring belt was evaluated for cracking resistance on the basis of the criteria described below. The results are shown in Table 1.

—Criteria of Evaluation—

A: Average number of cracks of 0 (passed)

B: Average number of cracks of more than 0 and less than 10 (not passed)

C: Average number of cracks of 10 or more (not passed)

(3) Evaluation of Image Transferability to Coarse Paper

Intermediate transferring belts [1] to [7] were each mounted in an image-forming apparatus "bizhub PRESS C6000" (manufactured by KONICA MINOLTA, INC.), and a solid image (toner density: 100%) was printed with each apparatus on 10 sheets of Leathac paper.

Each of the printed solid images was digitized with a scanner, and subjected to image processing with image editing and processing software "Photoshop" (manufactured by Adobe Systems), to determine an average image density of the solid image. The area percentage of regions with an image density of 90% or less of the average image density was determined in each solid image, and the resultant area percentages were averaged for each intermediate transferring belt (hereinafter the averaged percentage will be referred to as "percentage of region with 90% or less image density"). The intermediate transferring belt was evaluated for image transferability on the basis of the criteria described below. The results are shown in Table 1.

—Criteria of Evaluation—

A: A percentage of region with 90% or less image density of 3% or less (passed)

B: A percentage of region with 90% or less image density of more than 3% and 5% or less (not passed)

C: A percentage of region with 90% or less image density of more than 5% (not passed)

(4) Evaluation of Coefficient of Friction

The coefficients of friction of intermediate transferring belts [1] to [7] were determined as described above. The results are shown in Table 1. In the present invention, an intermediate transferring belt having a coefficient of friction of 0.5 or less is regarded as "passed" (i.e., tack-free surface).

TABLE 1

| | INTERMEDIATE TRANSFERRING BELT No. | MONOMER COMPOSITION (A) CYCLOHEXYL ACRYLATE TYPE | AMOUNT, PARTS BY MASS | (B) URETHANE ACRYLATE TYPE | AMOUNT, PARTS BY MASS | RESULTS OF EVALUATION CRACKING RESISTANCE | WEAR RESISTANCE | IMAGE TRANSFERABILITY TO COARSE PAPER | COEFFICIENT OF FRICTION |
|---|---|---|---|---|---|---|---|---|---|
| EXAMPLE 1 | [1] | CYCLOHEXYL ACRYLATE | 20 | UV6630B | 80 | A | A | A | 0.3 |
| EXAMPLE 2 | [2] | 4-ACRYLOYL-MORPHOLINE | 30 | | 70 | A | A | A | 0.4 |
| EXAMPLE 3 | [3] | DICYCLO-PENTANYL ACRYLATE | 20 | | 60 | A | A | A | 0.2 |
| EXAMPLE 4 | [4] | PENTAMETHYL-PIPERIDYL ACRYLAT | 30 | | 80 | A | A | A | 0.3 |
| COMPARATIVE EXAMPLE 1 | [5] | (DPHA) | 20 | | 80 | A | B | C | 0.1 |
| COMPARATIVE EXAMPLE 2 | [6] | (DPHA) | 30 | | 70 | C | A | C | 0.1 |
| COMPARATIVE EXAMPLE 3 | [7] | ETHYL ACRYLATE | 20 | | 80 | A | B | C | 0.9 |

※ DPHA: DIPENTAERYTHRITOL HEXAACRYLATE

This application is based upon and claims the benefit of priority from the Japanese Patent Application No. 2015-092579, filed Apr. 30, 2015, the entire contents of which are incorporated herein by reference.

What is claimed is:

1. An intermediate transferring belt to be mounted in an electrophotographic image-forming apparatus, the intermediate transferring belt comprising, in sequence:

a substrate;

an elastic layer; and a surface layer, wherein, the surface layer includes an acrylic resin including a copolymer of a urethane acrylate and one or more acrylates selected from the group consisting of a monofunctional acrylate having an alicyclic structure and a monofunctional acrylate having a heterocyclic structure.

2. The intermediate transferring belt according to claim 1, wherein the alicyclic structure in the monofunctional acrylate having an alicyclic structure includes a cycloalkyl group.

3. The intermediate transferring belt according to claim 1, wherein the heterocyclic structure in the monofunctional acrylate having the heterocyclic structure includes a saturated heterocyclic ring.

4. The intermediate transferring belt according to claim 1, wherein a mass ratio of the urethane acrylate to the one or more acrylates selected from the group consisting of the monofunctional acrylate having the alicyclic structure and the monofunctional acrylate having the heterocyclic structure is within a range of 10/90 to 50/50.

5. An electrophotographic image-forming apparatus comprising:

a first transferring unit to primarily transfer an electrostatic toner image on an image retainer onto an intermediate transferring belt to be circulated; and a second transferring unit to secondarily transfer an intermediate toner image on the intermediate transferring belt onto an image support, wherein, the intermediate transferring belt is the intermediate transferring belt according to claim 1.

* * * * *